United States Patent [19]

Gungle et al.

[11] 4,383,197

[45] May 10, 1983

[54] METAL HALIDE ARC DISCHARGE LAMP HAVING SHIELDED ELECTRODE

[75] Inventors: W. Calvin Gungle, Danvers; William M. Keeffe, Rockport; Dale E. Work, Topsfield, all of Mass.

[73] Assignee: GTE Products Corporation, Stamford, Conn.

[21] Appl. No.: 956,950

[22] Filed: Nov. 2, 1978

[51] Int. Cl.[3] ..... H01J 61/10; H01J 61/18

[52] U.S. Cl. ..... 313/38; 313/602; 313/609; 313/631

[58] Field of Search ..... 313/38, 217, 206, 207

[56] References Cited

U.S. PATENT DOCUMENTS

| | | | |
|---|---|---|---|
| 2,008,066 | 7/1935 | Ende | 313/38 X |
| 2,725,495 | 11/1955 | Rively | 313/38 |
| 2,812,465 | 11/1957 | Germeshausen | 313/207 |
| 3,109,952 | 11/1963 | Reese | 313/207 |
| 3,761,758 | 9/1973 | Bamberg et al. | 313/229 |
| 3,764,842 | 10/1973 | Ridders et al. | 313/177 |
| 4,056,750 | 11/1977 | Latassa | 313/174 X |
| 4,056,751 | 11/1977 | Gungle et al. | 313/217 |
| 4,117,374 | 9/1978 | Witting | 313/217 X |

*Primary Examiner*—Palmer C. Demeo

*Attorney, Agent, or Firm*—James Theodosopoulos

[57] ABSTRACT

A shield is disposed about the electrode of a metal halide arc discharge lamp in order to improve lamp performance. The construction and location of the shield are such as to not lower the cold-spot temperature of the arc tube.

1 Claim, 2 Drawing Figures

METAL HALIDE ARC DISCHARGE LAMP HAVING SHIELDED ELECTRODE

THE INVENTION

This invention is concerned with high intensity metal halide arc discharge lamps. Such lamps comprise an arc tube having electrodes. An example of such a lamp is shown in U.S. Pat. No. 3,761,758.

The invention is particularly concerned with reducing the arc tube discoloration that can occur during lamp ignition because of sputtering of the electrodes or that might occur because of electrode vaporization during normal lamp operation.

We have found that a shield disposed about the electrode can reduce discoloration and thereby improve lumen maintenance during lamp life. However it is not enough to merely shield the electrode such as is disclosed, for example, in U.S. Pat. Nos. 3,764,842 and 4,056,750 relating to fluorescent lamps or in U.S. Pat. No. 2,812,465 relating to flash tubes. The shields there are either too massive relative to the electrode or are too distantly spaced from the electrode or are only moderately heated by the electrode. In our invention the shield must be of low mass relative to the electrode and must be sufficiently proximate the electrode so as to not upset the thermal balance on the arc tube wall. That is to say, the shield must be such as to not provide a significantly colder cold-spot temperature in the arc tube than the cold-spot temperature of the arc tube without a shield about the electrode. If the shield is such as to provide a significantly colder cold-spot temperature, then the thermal balance on the arc tube will be affected, which can reduce lamp efficacy. In the prior art discharge lamps having shields around the electrodes, cold-spot temperature is either not a factor in lamp operation, as in flash tubes, or is not affected by the size and location of the shields, as in low pressure discharge lamps, that is to say, fluorescent lamps.

Figure 1:
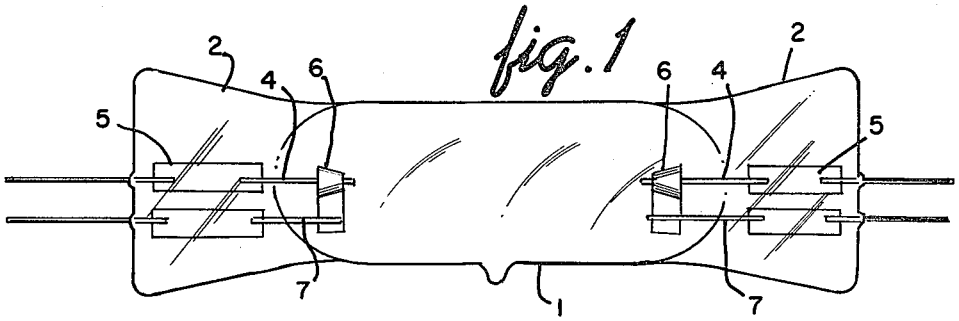
FIG. 1 shows an arc tube for a metal halide arc discharge lamp.

Arc tube 1 is the usual type of arc tube for a metal halide arc discharge lamp and contains a filling including a starting gas and a metal halide. The usual press seals 2 seal the ends of arc tube 1. Electrodes 3 supported on rods 4 are disposed at the ends of arc tube 1, rods 4 being embedded in press seals 2 and connected to the usual foliated ribbons 5. Disposed around each electrode is a shield 6. In the embodiment shown, shield 6 is conically shaped and is slightly longer than the coiled portion of electrode 3. Shield 6 is made of 1 mil tungsten sheet metal and is fastened to and supported by a rod 7, which is supported in press seal 2. In order to prevent the discharge from striking shield 6 after lamp ignition, the internal tip of rod 4 protrudes beyond shield 6. Also, in this embodiment, shield 6 is sufficiently proximate electrode 3 so as to be heated to incandescence by radiation therefrom during lamp operation. Lamps (400 watt) as per this embodiment had a 97% maintenance after 1000 hours operation versus a standard maintenance of 76% for said lamps without shields. Initial lumens were, respectively, 37,500 and 38,500.

It is not necessary, for purposes of this invention, that shield 6 completely encircle electrode 3. In some cases, it may only be necessary to shield part of the arc tube wall. For example, in the case of an arched arc tube where the electrode is more proximate the lower arc tube wall, as shown in U.S. Pat. No. 4,056,751, any discoloration of said lower arc tube wall portion would have an insignificant effect on the light output because of the small area involved. However, discoloration of the upper arc tube wall portion proximate the electrode would significantly decrease light output because a relatively large area would be involved. Thus it would only be necessary to shield said upper wall portion from the electrode.

It is desirable that shield 6 be electrically insulated from electrode 3 during normal lamp operation in order to prevent the discharge from striking shield 6, because shield 6 has insufficient mass to withstand the discharge. However, shield 6 may be utilized as the starting electrode provided a switch is used for electrical isolation thereof after lamp warmup, as shown in U.S. Pat. No. 3,761,758.

Figure 2:
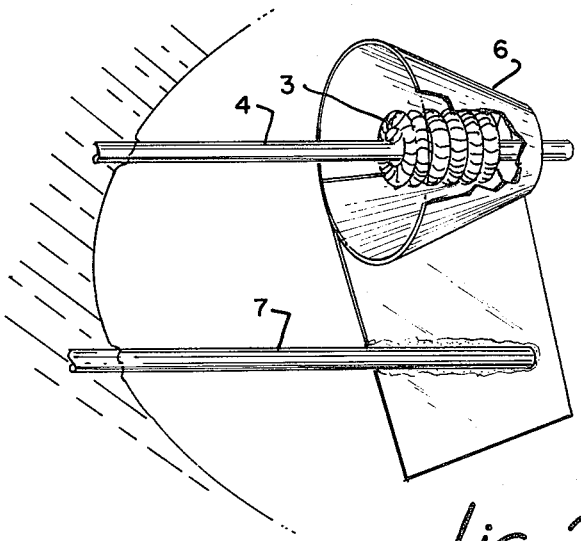
FIG. 2 is an expanded partly sectional view of a shield disposed about an electrode.

A simple method of determining whether the addition of a shield as per this invention provides a colder cold-spot temperature is to observe the location of the metal halide condensate at room temperature. If the shield moves the condensate location to a colder spot, then the shield is upsetting the thermal balance of the arc tube. The cold-spot quite often is in the electrode region, to the rear thereof. Preferably, the shield should not shift the cold-spot location or, ideally, it should increase the cold-spot temperature, thereby increasing the halide vapor pressure during lamp operation which can improve lamp performance. When the cold spot temperature is directly behind the electrode, a conical shield 6, as shown in FIG. 2, can, in some cases, actually increase said cold-spot temperature.

We claim:

1. A high intensity arc discharge lamp comprising an arc tube having electrodes and containing a fill including a starting gas and a metal halide, and a shield disposed about an electrode having a tip, the construction and location of the shield being such that the cold-spot temperature of the arc tube is not significantly lowered by the presence of said shield, said shield being heated to incandescence during normal lamp operation.

* * * * *